United States Patent [19]

Seragnoli

[11] Patent Number: 4,646,758

[45] Date of Patent: Mar. 3, 1987

[54] PRODUCTION MACHINE FOR THE SIMULTANEOUS MANUFACTURE OF CONTINUOUS CIGARETTE RODS

[75] Inventor: Enzo Seragnoli, Bologna, Italy

[73] Assignee: G.D Societa' per Azioni, Bologna, Italy

[21] Appl. No.: 523,327

[22] Filed: Aug. 15, 1983

[30] Foreign Application Priority Data

Sep. 8, 1982 [IT] Italy ..... 3524 A/82

[51] Int. Cl.[4] ..... A24C 5/14; A24C 5/39

[52] U.S. Cl. ..... 131/84.3; 131/84.4; 131/110

[58] Field of Search ..... 131/84 R, 84 C, 110, 131/84 A, 84 B

[56] References Cited

U.S. PATENT DOCUMENTS 4,336,812 9/1984 Seragnoli ..... 131/84 B

FOREIGN PATENT DOCUMENTS 0221938 3/1981 Argentina .
80/2825 6/1981 South Africa .
0491709 4/1981 Spain .

*Primary Examiner*—Vincent Millin
*Attorney, Agent, or Firm*—Marshall, O'Toole, Gerstein, Murray & Bicknell

[57] ABSTRACT

Production machine for the simultaneous manufacture of continuous cigarette rods, the said machine comprising a shredded tobacco feed unit with up channels arranged side by side and crosswise in relation to the direction in which the tobacco is fed to the said feed unit. The channels communicate at the bottom with a shredded tobacco conveyor common to both and comprise essentially vertical bottom sections arranged side by side, each of which is separated from the bottom section of the adjacent channel by means of a movable partition.

5 Claims, 2 Drawing Figures

PRODUCTION MACHINE FOR THE SIMULTANEOUS MANUFACTURE OF CONTINUOUS CIGARETTE RODS

BACKGROUND OF THE INVENTION

The present invention relates to a production machine for the simultaneous manufacture of continuous cigarette rods. U.S. Pat. No. 4,336,812 filed by the same Applicant, G.D. S.p.A., describes a production machine of the aforementioned type, designed to manufacture two continuous cigarette rods simultaneously by feeding two belts of shredded tobacco over the same number of continuously moving adjacent paper strips. The sides of the latter are then overlapped and stuck down to form two cigarette rods which are then cut into cigarettes. On the aforementioned production machine, each paper strip is supplied with tobacco by a suction conveyor belt which, in turn, is supplied by a feed unit. According to the aforementioned American Patent, the said feed unit comprises two up channels, or flues, arranged side by side in relation to the direction in which the said paper strips are fed. The said channels are also assembled with the bottom inlets over a common conveyor belt and aligned crosswise in relation to the direction in which the said conveyor travels.

Downstream from the said inlets, the said channels fork out so that the top ends pass under the said suction conveyor belts which are arranged parallel to each other.

The known production machine described is not, however, without its drawbacks: as the tobacco from the said conveyor is fed into each of the said two sloping channels, it is forced along routes of different curvature the different flow resistances of which make it difficult to ensure, as is necessary, that exactly the same amount of tobacco is fed into the channels at all times. This applies in particular to the larger, heavier tobacco shreds which are less affected by the said suction means and may, in the case of the channel with greater flow resistance, fall off the end of the said conveyor and fail to be fed into the channel.

What is more, unless substantial alterations are made, the structure of the known production machine described does not provide for accurate control of the said channel sections for correcting any difference in flow.

SUMMARY OF THE INVENTION

The aim of the present invention is to provide a production machine to overcome the aforementioned drawbacks. With this aim in view, the present invention relates to a production machine for the simultaneous manufacture of continuous cigarette rods, the said machine comprising at least two up channels for feeding shredded tobacco, the said channels being arranged between a common conveyor belt at the bottom and respective essentially parallel suction conveyors at the top, each of the said channels having an extended section, with the longitudinal axis arranged essentially parallel to the said suction belts and crosswise in relation to the travelling direction of the said conveyor, each channel being arranged so that the top outlet is located underneath the relative suction belt, characterised by the fact that the initial or inlet sections of the said channels are aligned to each other according to the said longitudinal axes with partitioning means between adjacent channels at the said initial section point.

BRIEF DESCRIPTION OF THE DRAWINGS

The invention will now be described with reference to the attached drawings, provided by way of a non-limiting example, in which.

DETAILED DESCRIPTION OF THE INVENTION

Figure 1:
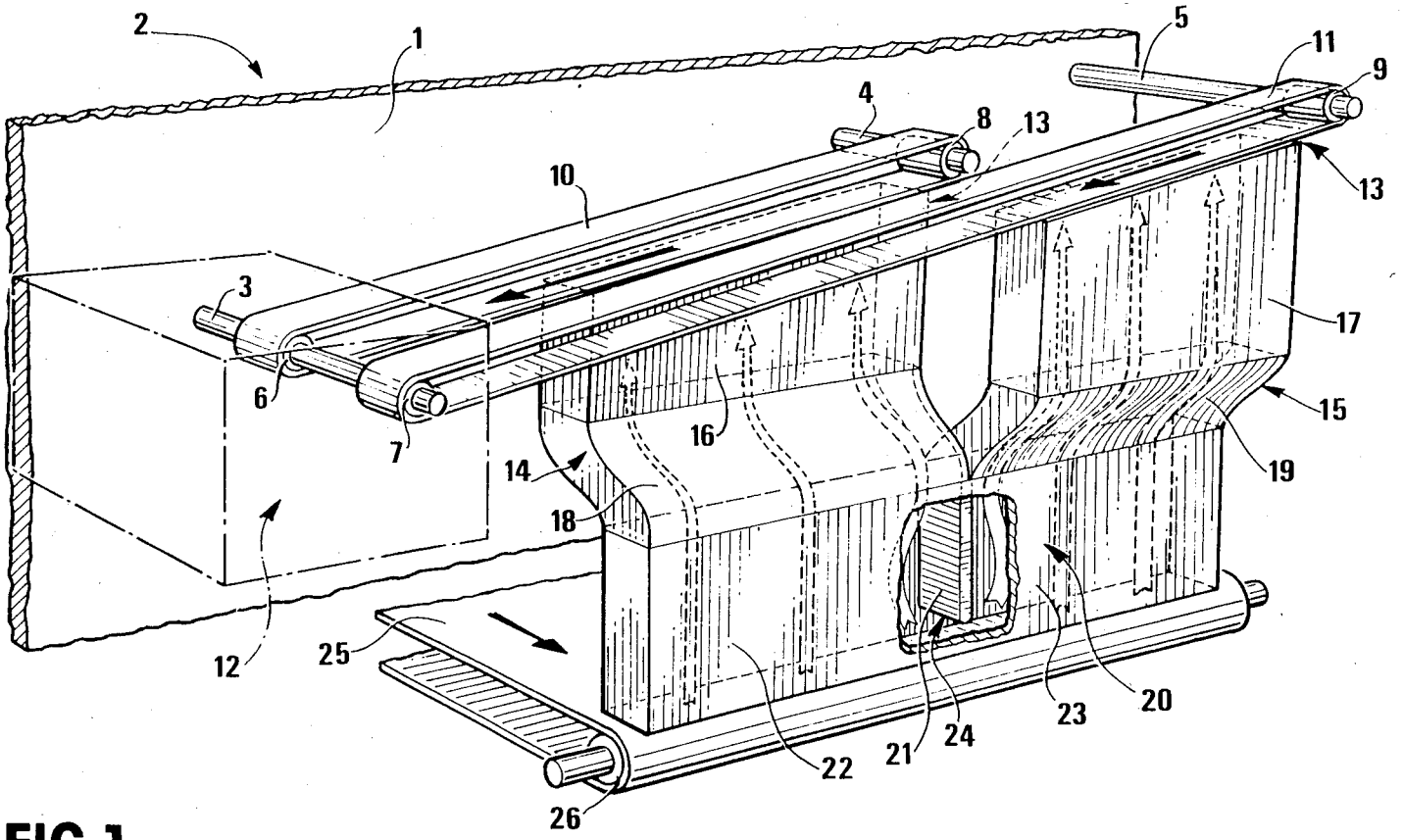
FIG. 1 shows a schematic perspective view of a cigarette manufacturing machine according to the present invention.

With reference to the attached drawings, number 1 indicates a vertical panel forming part of the base of a cigarette manufacturing machine (2) designed to produce two cigarette rods (not shown) simultaneously.

Panel 1 supports three revolving shafts, assembled perpendicular to it and marked, from left to right, 3, 4 and 5 on the drawings. The first is assembled lower than the other two and is connected to power means (not shown) for turning it counterclockwise.

Shaft 3 is fitted with two adjacent rollers, 6 and 7, the first of which contacts panel 1, whereas shafts 4 and 5 are fitted with rollers 8 and 9 respectively, aligned to the said rollers 6 and 7 and parallel to panel 1.

On to roller pairs 6–8 and 7–9 are looped belts 10 and 11 respectively through the bottom face of which a suction force is exerted by means not shown in the drawings.

Downstream from belts 10 and 11, a section (12) is provided for wrapping tobacco in strips of paper, whereas underneath are situated the top ends (13) of two up channels (14, 15) with extended, essentially rectangular sections and the horizontal axis essentially parallel to belts 10 and 11. Channels 14 and 15 comprise vertical top outlets, 16 and 17, respectively, the said outlets being blended respectively at the bottom into sections 18 and 19 arranged at an angle to a vertical section between belts 10 and 11. The bottom ends of the said sections 18 and 19, in turn, communicate with respective parts of the cross section of a single, essentially vertical passage, 20. The section of passage 20 is extended, essentially rectangular, more or less the same width as belts 10 and 11 and practically twice the length of ends 13.

Passage 20 is also provided inside with partitioning means, consisting of cross baffle 21, which divides it into two passages or bottom sections 22 and 23, which communicate respectively with sections 18 and 19 and constitute inlet sections for channels 14 and 15 respectively.

As the bottom edge (24) of baffle 21 is raised in relation to the bottom end of passage 20, passages 22 and 23 share a relatively short bottom section.

Underneath the bottom inlets of channels 14 and 15 is one end of conveyor belt 25, which is essentially horizontal and moves essentially crosswise in relation to the direction of travel of belts 10 and 11. Belt 25 is looped round a pair of rollers, 26 (only one of which is shown in the drawing) and is powered by means not shown in the drawing so as to feed the bottom inlets of channels 14 and 15 with shredded tobacco from a carding unit not shown in the drawing. When the machine is operated, the tobacco fed under channels 14 and 15 by conveyor 25 is forced into sections 22 and 23 of the said channels by the said suction means connected to belts 10 and 11. After moving right along channels 14 and 15, the tobacco clings to the bottom of belts 10 and 11 by which it is sent to the wrapping section (12). As sections 22 and 23 of channels 14 and 15 have exactly the same slope in relation to conveyor 25, the tobacco entering channels 14 and 15 is subject to exactly the same flow resistance.

According to a variation not shown in the drawings, the top sections (16, 17) of channels 14 and 15 are suppressed and the channels arranged with the top ends of sloping sections 18 and 19 facing belts 10 and 11.

According to a further variation not shown in the drawings, passage 20 is arranged at any angle, other than the essentially 90° angle shown, in relation to conveyor 25.

Figure 2:
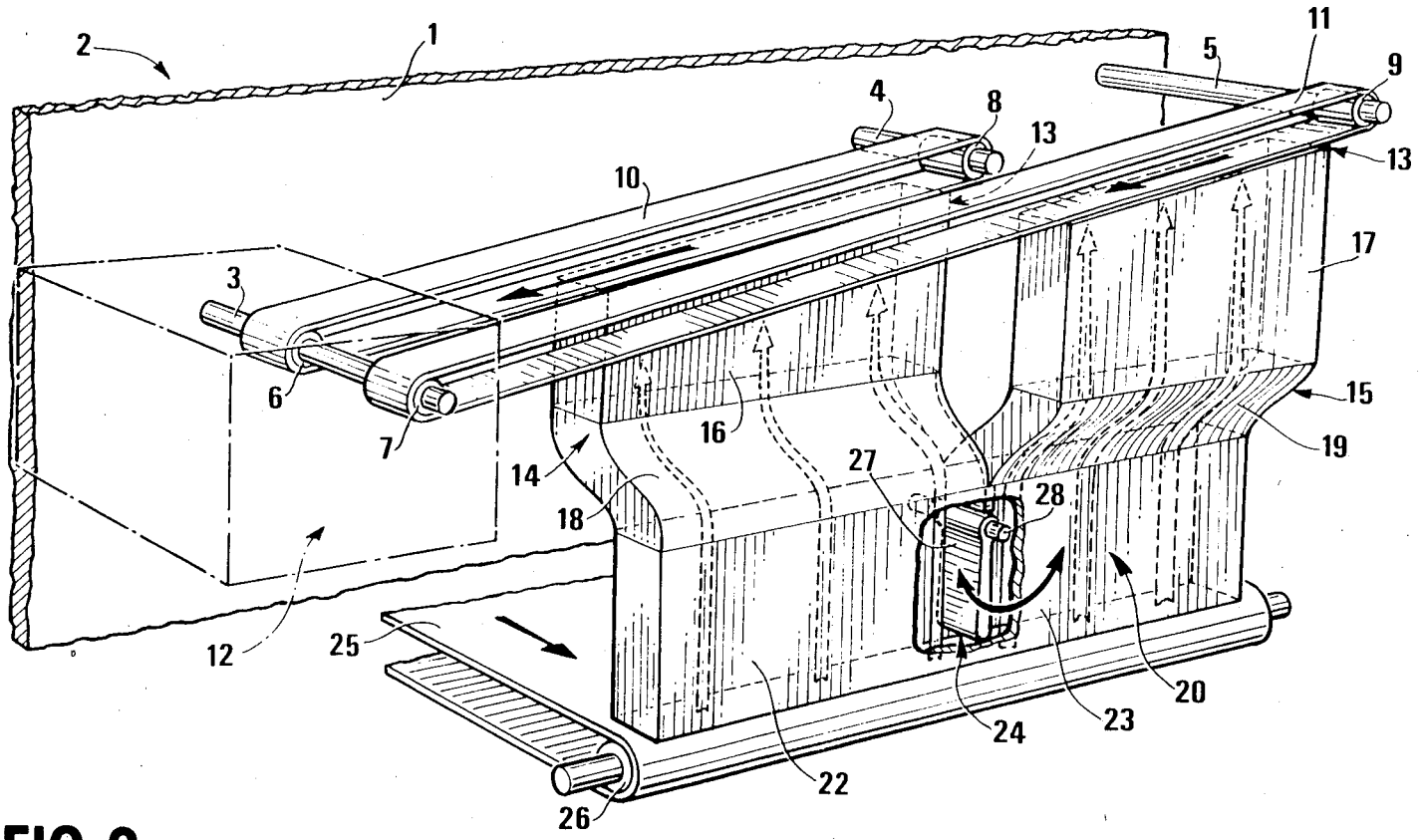
FIG. 2 shows a perspective view of a modified version of the FIG. 1 machine.

According to the variation shown in FIG. 2, baffle 21 of FIG. 1 is replaced by an essentially rectangular partition (27) the top end of which is connected to the larger side panels of passage 20 by an essentially horizontal pin (28) parallel to the axis of conveyor 25.

Pin 28 is preferably connected to power means (not shown), in turn connected to known detectors (not shown) designed, for example, to keep a constant check of the tobacco shreds travelling along belts 10 and 11, to compare the findings both with each other and with a given reference value, and to activate partition 27 so as to remove any discrepancy in flow.

In connection with the above function, it should be pointed out that even a wide swing of partition 27 results in a very small variation of the inlet sections of channels 14 and 15. Consequently, operation of partition 27 provides for relatively fine adjustment of the amount of tobacco being fed along belts 10 and 11.

The above description with reference to FIGS. 1 and 2 applies to a production machine comprising two channels (14, 15) emerging on to respective belts 10 and 11. Nothing, however, prevents the above type of machine from being designed with any number of channels, separated from each other by fixed or movable baffles and emerging on to the same number of suction belts.

I claim:

1. A double cigarette rod making machine comprising:

a lower belt conveyor for advancing shredded tobacco in a first direction;

two upper suction conveyors (10, 11) arranged substantially parallel to one another for advancing shredded tobacco in a second direction substantially at right angles to said first direction;

two up channels (14, 15) arranged in a side-by-side relationship with each extending between said lower conveyor and a respective one of said upper suction conveyors;

each said up channel having an elongated horizontal cross section, a longitudinal axis of which extends transversely of said first direction and substantially parallel to said second direction; and said up channels having lower inlet sections (22, 23), the longitudinal axes of which extend at substantially identical angles to said first direction.

2. A machine according to claim 1 wherein the elongated cross sections of said lower inlet sections have their longitudinal axes aligned with one another and extending transversely of said first direction.

3. A machine according to claim 1 wherein common partition means (21) is provided to separate said lower inlet sections from one another; with said common partition means being parallel to said first direction and having a lower end (24) arranged above, and at a distance from, an upper tobacco supporting surface of said lower conveyor.

4. A machine according to claim 3 wherein said partition means comprises a rigid wall (21).

5. A machine as claimed in claim 3 wherein said partition means comprises a wall (27) mounted for movement about an axis (28) extending parallel to said first direction.

* * * * *